US005231739A

United States Patent [19]

Mattesky

[11] Patent Number: 5,231,739

[45] Date of Patent: Aug. 3, 1993

[54] IRONING BOARD SECURING CLIP

[75] Inventor: Henry Mattesky, Cedar Grove, N.J.

[73] Assignee: Herbert Glatt, Morristown, N.J.

[21] Appl. No.: 818,865

[22] Filed: Jan. 10, 1992

[51] Int. Cl.[5] ..... A44B 21/00

[52] U.S. Cl. ..... 24/556; 24/326; 24/545

[58] Field of Search ..... 24/556, 541, 545, 563, 24/573.1, 326, 458, 351, 3 J, 3 L, 30.5 R, 30.5 S, 265 C, 295, 562, 289, 293

[56] References Cited

U.S. PATENT DOCUMENTS

| | | | |
|---|---|---|---|
| 1,256,426 | 2/1918 | Baltzley | 24/545 |
| 1,323,838 | 12/1919 | Copp | 24/326 |
| 1,417,325 | 5/1922 | Hopp | 24/531 |
| 1,731,986 | 10/1929 | Rooney | 24/531 |
| 2,003,856 | 6/1935 | Gimbel | 24/562 |
| 2,137,652 | 11/1938 | Lundberg et al. | 24/458 |
| 2,393,514 | 1/1946 | Bicknell | 24/556 |
| 2,511,808 | 6/1950 | Petri | 24/295 |
| 3,089,211 | 5/1963 | Perusse | 24/556 |
| 3,141,221 | 7/1964 | Faulls, Jr. | 24/30.5 R |
| 3,205,549 | 9/1965 | Keech | 24/30.5 R |
| 3,300,168 | 1/1967 | Gaudino | 24/326 |
| 3,458,110 | 7/1969 | Goldman | 24/30.5 R |
| 4,074,465 | 2/1978 | Bright | 24/289 |

FOREIGN PATENT DOCUMENTS

| | | | |
|---|---|---|---|
| 0655633 | 4/1929 | France | 24/545 |
| 0076286 | 10/1954 | Netherlands | 24/563 |
| 0807721 | 1/1959 | United Kingdom | 24/563 |
| 0869718 | 6/1961 | United Kingdom | 24/563 |
| 2174451 | 11/1986 | United Kingdom | 24/293 |
| 2201721 | 9/1988 | United Kingdom | 24/30.5 R |

*Primary Examiner*—Victor N. Sakran

*Attorney, Agent, or Firm*—Omri M. Behr; Matthew J. McDonald

[57] ABSTRACT

The securing clip of the invention comprises a top plate segment, a bottom plate segment and a joining segment which flexibly links the top and bottom plate segments. Each of the top and bottom plate segments has an upper and a lower surface. The lower surface of the top plate confronts the upper surface of the bottom plate segment and these two surfaces, along with the internal face of the joining segment thereby define a partially closed spaced. There is provided on the lower surface of the top plate segment, at least one finger protruding downwardly into the space. This finger and the lower surface define an angle facing the joining segment which is 90° or less.

18 Claims, 5 Drawing Sheets

IRONING BOARD SECURING CLIP

FIELD OF THE INVENTION

Clip for securing an ironing board cover to an ironing board.

BACKGROUND OF THE INVENTION

Ironing of clothes is an ongoing household chore because clothes always wrinkle during washing. Several minor problems which frequently arise during ironing make this chore one of the least favorite in the household. Among these problems are the scorching of garments, the safety problems in using a hot iron, the sorting of laundry required by different fabric types needing different ironing temperatures and steam and/or starch treatments, and finally the securing of garments on the ironing board.

Conventional ironing boards are covered with a heat reflective cloth cover. These ironing board covers serve to insulate the board's base from heat and to reflect heat from an iron back to the garment to increase the efficiency of wrinkle removal. This ironing board cover is secured to the board base generally by a drawstring, tightened beneath the board. This drawstring causes the perimeter of the cover to grip the perimeter edges of the board. Yet, with the back and forth motion of the iron during pressing along the longitudinal and transverse axes of the ironing board, the portions of the cover at the board peripheral edges are frequently tugged. This repeated tugging causes the drawstring of the cover to be loosened, which results gradually in overall loosening of the ironing board cover.

Thus, a further nuisance associated with the chore of ironing is loosening of the cover with resultant slippage of the cover over the ironing board base. Because garments to be pressed tend to slip along with such a loosened cover, this loosening renders pressing of garments more difficult.

The person wishing to press garments must then either interrupt pressing and retighten the drawstring or use a makeshift measure, such as holding the cover in place by hand.

Applicant has invented an ironing board securing clip which more effectively clamps the cover to the board, thereby reducing transverse pulling and resulting loosening. In maintaining cover tautness, this clip therefore reduces the time required to perform clothes ironing.

SUMMARY OF THE INVENTION

In one embodiment, the securing clip comprises a top plate segment, a bottom plate segment and a joining segment which flexibly links the top and bottom plate segments. Each of the top and bottom plate segments has an upper and a lower surface. The lower surface of the top plate confronts the upper surface of the bottom plate segment and these two surfaces, along with the internal face of the joining segment thereby define a partially closed spaced. There is provided on the lower surface of the top plate segment, at least one finger protruding downwardly into the space. This finger and the lower surface define an angle facing the joining segment which is 90° or less.

Alternatively, the finger may protrude upwardly from the upper surface of the lower segment at an angle of 90° or more.

In this embodiment, the top and bottom plate segments may be substantially planar. When these segments are planar, they may further be substantially parallel to one another. When this is the case, the joining segment may be brace, which is substantially perpendicular to both the top and bottom plate segments.

Alternatively, the joining segment need not be perpendicular to both segments but may be, for example, perpendicular to the top plate segment but have its internal surface form an angle with the upper surface of the bottom plate of less than 90°. Further, the angle between the internal surface of the joining segment and the lower surface of the top plate may also be less than 90°.

In a further embodiment, the above described securing clip may further have at least one finger protruding from the upper surface of the bottom plate segment. This finger protruding upwardly into the partially closed space and may, if desired, define with upper surface of the bottom plate segment, an angle of 90° or less.

In yet another embodiment, the internal surface of the joining segment may define a curved convex segment. As a result, the cross-section of the partially closed space is U-shaped.

In another embodiment of the securing clip, there may be provided a "drooping lip" on at least one of the top or bottom plate segments. This lip constitutes a portion of the bottom plate segment which departs from the planar at the forward edge of the segment, i.e., at the edge remote from the joining segment. The lip has an upper and a lower surface, the upper surface of which protrudes substantially across the entire forward edge of the bottom plate segment. With the upper surface of the bottom plate segment, the upper surface of the lip defines an angle of greater than 180°.

In another embodiment, there is provided a shoulder on at least one of the top and bottom plate segments. Each of these segments has two opposed side edges as well as the forward edge which is opposed to the joining edge. The shoulder is defined by a portion of at least one of the plate segments at one side edge thereof, which departs from the planar. This shoulder extends from the internal surface of the joining segment substantially along the entire length of the side edge of the plate segment. The shoulder has an upper and a lower surface, the upper surface forming an angle of greater than 180° with the upper surface of the relevant plate segment.

In a further embodiment, the angle formed by both the internal surface of the joining segment with both the lower surface of the top plate segment and the upper surface of the bottom plate segment is less than 90°. The forward edge of the top and the bottom plate segments here are not parallel. As a result, the mouth formed by these two forward edges tapers in width from a first side of the mouth to a second side thereof.

The securing clip described herein may be produced to fit on any conventional ironing board such as those having thickness of from ⅛ to 2", due to use of peripheral square metal tubing or those with thickness of ¼ to ½" due to peripheral support edge banding in place of such tubing.

DETAILED DESCRIPTION OF THE DRAWINGS

DETAILED DESCRIPTION OF THE PREFERRED EMBODIMENTS

Figure 1:
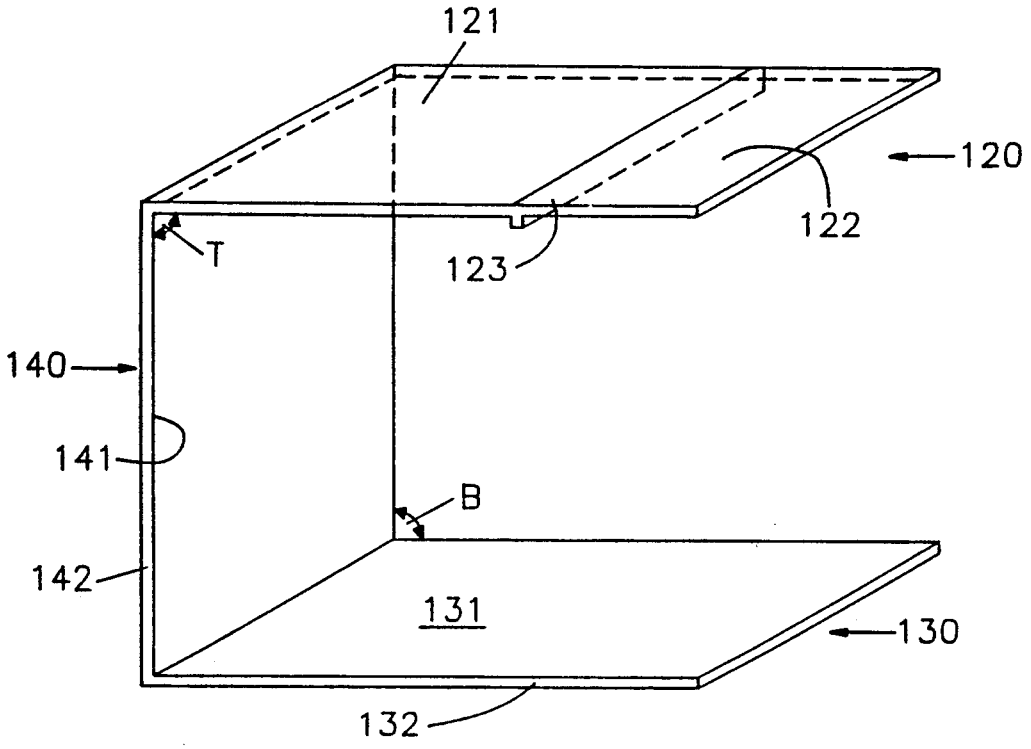
FIG. 1 illustrates a downward perspective view of a securing clip.

In a first embodiment, the securing clip comprises a top plate segment 120 and a bottom plate segment 130, flexibly joined to one another by joining segment 140. The top plate segment has upper surface 121 and lower surface 122. Similarly, the bottom plate segment has upper surface 131 and lower surface 132. The joining segment has internal surface 141 and external surface 142.

The lower surface 122 of top plate segment 120 confronts the upper surface 131 of bottom plate segment 130. Thus, the two opposed plates 120 and 130 with the joining segment 140 define a partially closed space.

At least one finger 123 protrudes from the lower surface 122 of top plate segment 120 downwardly into this space. The finger 123 together with the lower surface 122 define an angle X facing the internal surface 141 of joining segment 140, which angle is 90° or less. Finger 123 extends substantially across the entire width of surface 122.

The top and bottom plate segment 120 and 130 may suitably be substantially planar. When this is the case, the lower surface 122 of top plate segment 120 and the upper surface 131 of bottom plate segment 130, may suitably be substantially parallel. When this is the case and the internal surface 141 of joining segment 140 meets the lower surface 122 of top plate segment 120 and the upper surface 131 of bottom plate segment 130 in a substantially perpendicular manner, then the joining segmen· 130 acts as a brace for both the top and bottom plate segments. This embodiment is illustrated in FIGS. 1 and 2 where the angles indicated by T and B are substantially 90° angles.

However, one may suitably choose to form the securing clip with an angle T and/or angle B of less than 90°. Thus, the securing clip may have the internal surface 141 of joining segment 140 form an angle with the lower surface 122 of top plate segment 120 of 90° but have an angle formed by the internal surface 141 of joining segment 140 and the upper surface 131 of bottom plate segment 130 of less than 90° and if one wishes, the securing clip may have angles T and B both be less than 90°: in such a securing clip the internal surface 141 of joining segment 140 forms an angle with both the lower surface 122 of top plate segment 120 and with the upper surface 131 of bottom plate segment 130, said angle being less than 90°.

(It is noted that the reference numbers appearing in the Figures and this discussion indicate elements of a securing clip in the particular embodiment illustrated. However, as a general rule, the last two digits of any reference number generally correspond to the same element in one or more of the illustrated securing clips embodiments).

Figure 2:
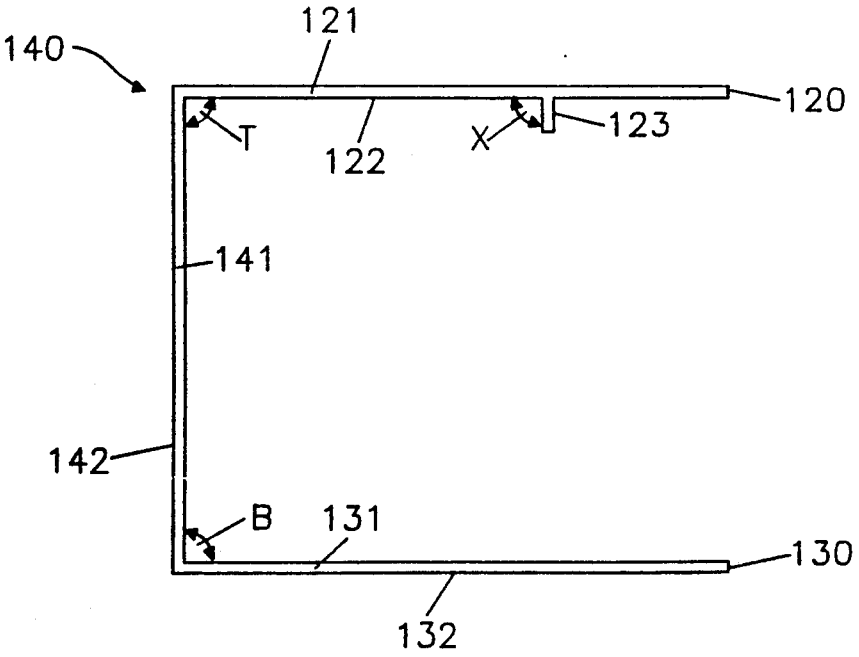
FIG. 2 illustrates a side elevational view of the clip shown in FIG. 1.

As seen in FIG. 2, all three of angles X, T and B of the securing clip shown in FIG. 1 may be substantially 90°.

In a further embodiment, a securing clip may have top plate segment 320 flexibly joined to bottom plate segment 330 by joining segment 340. In this embodiment, top plate segment 320 has upper surface 321 and lower surface 322, bottom plate segment 330 has upper surface 331 and lower surface 332 and joining segment 340 has internal surface 341 and external surface 342. As in the above embodiment, lower surface 322 of top plate segment 320 confronts upper surface 331 of bottom plate segment 330 across a partially closed space.

This embodiment further comprises, if desired, at least one finger 323 protruding from lower surface 322 of the top plate segment 320 downwardly into said space. This finger 323 defines an angle with the lower surface 322 which angle facing the internal surface 341 of joining segment 340 is of 90° or less.

This embodiment even further comprises at least one finger 333 protruding from the upper surface 331 of bottom plate segment 330 upwardly into the space. This finger 333 defines an angle Y with the upper surface 331 which angle facing the internal surface 341 of joining segment 340 is of 90° or more. At least finger 323 or finger 333 or pluralities of each must be present.

Figure 3:
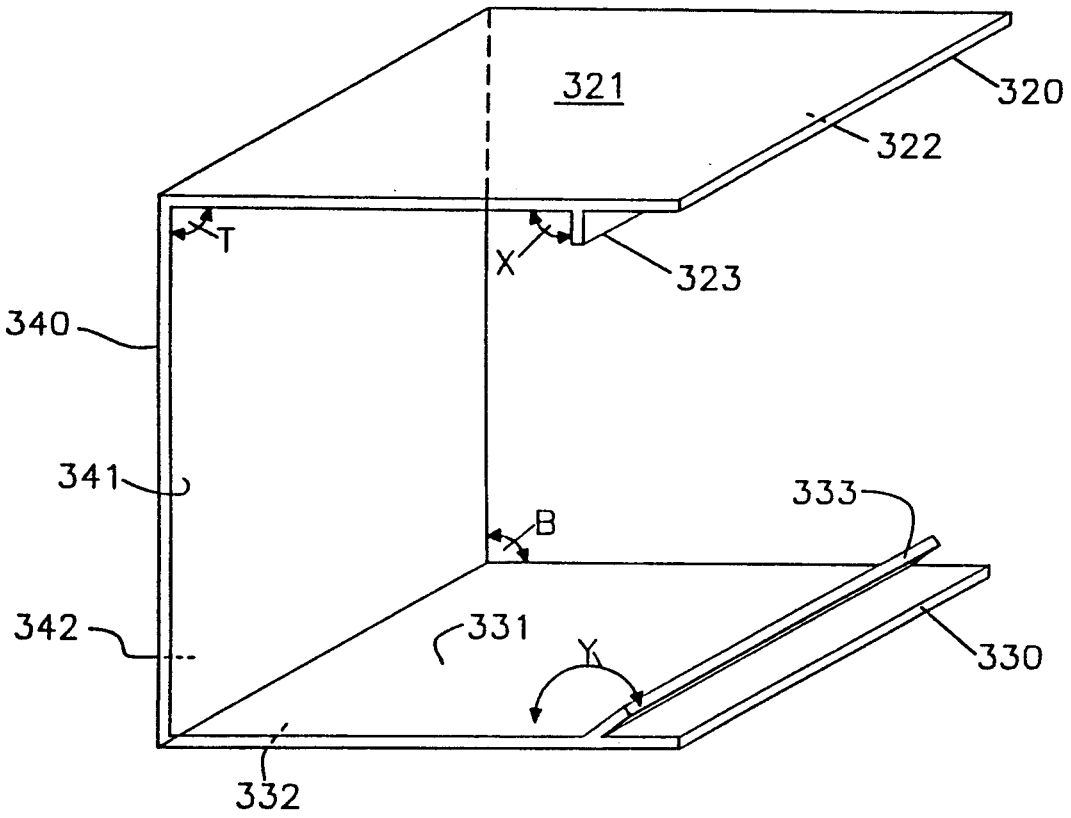
FIG. 3 illustrates a downward perspective view another embodiment of a securing clip.
Figure 4:
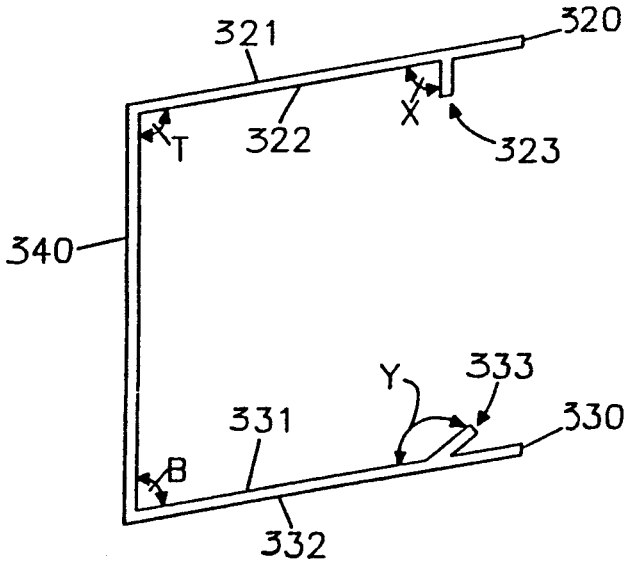
FIG. 4 illustrates a side elevational view of the clip shown in FIG. 3.

As illustrated in FIG. 4, angles T and X of the clip shown in FIG. 3 are substantially 90° angles, while angle B is less than 90° and angle Y is greater than 90°.

Figure 5:
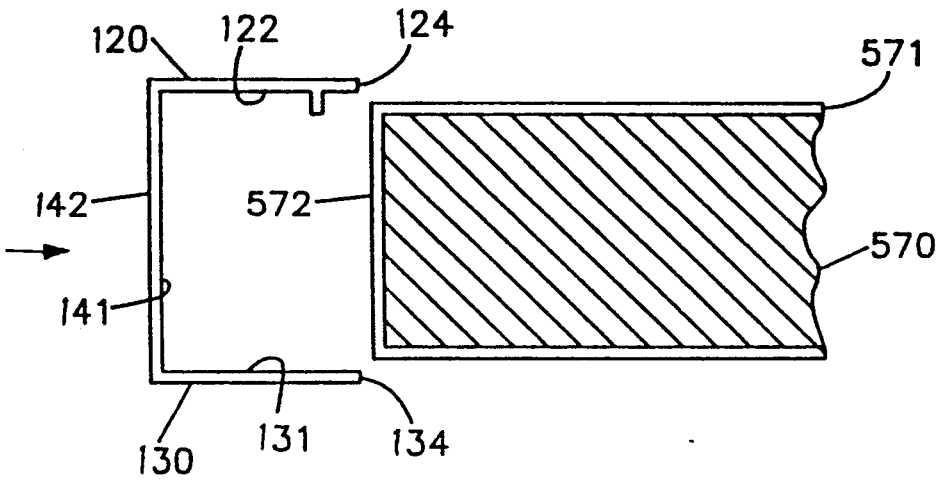
FIG. 5 illustrates a side elevational view of the securing clip of FIG. 1, engaged with an ironing board and an ironing board cover.
Figure 6:
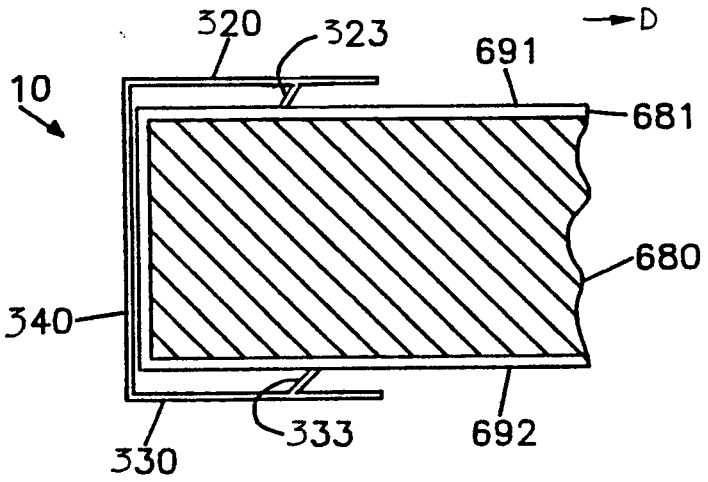
FIG. 6 illustrates a side elevational view of the securing clip of FIG. 3 engaged with an ironing board and an ironing cover.

Installation of the clip on an ironing board is shown in FIGS. 5 and 6. In order to place the securing clip on an ironing board, one first positions the forward edges 124 and 134 of top plate segment 120 and bottom plate segment 130 adjacent to the narrow side surface of an ironing board 570 covered by an ironing board cover 571 as shown in FIG. 5. (The securing clips are dimensioned to be slidably engagable with ironing boards of standard dimensions as discussed below). One then engages the clip with the top and bottom surfaces of the ironing board by exerting pressure in the direction of the arrow in FIG. 5. In other words, one pushes on the outer surface 142 of joining segment 140 optionally rocking the securing clip up and down, until the lower surface 12 of top plate segment 120 and the upper surface 131 of lower plate segment 130 slide past ironing board cover narrow edge 572 and engage with ironing board cover upper and lower surfaces. One generally pushes on the external surface 142 of joining segment 140 until the securing clip can proceed no further. This point is generally reached when internal surface 141 of joining segment 140 confronts and contacts the narrow side surface 572 of the ironing board cover.

FIG. 6 illustrates an embodiment of the securing clip (shown in FIG. 3) with an ironing board 680 and its cover 690. (The dimensions of the securing clip are enlarged in this drawing to illustrate clearly its constituent parts as well as those of the ironing board. However, preferred embodiments of the securing clip fit much more snugly with the ironing board and do not have as much space as is indicated in FIG. 6).

During ironing, movement of the iron on ironing board cover 690 tends to drag that cover in several directions including direction D, indicated by the arrow in FIG. 6. Such a force on ironing board cover 690 would in the absence of the securing clip, tend to pull that portion of the cover 691 which is atop the ironing board, as well as the portion of the ironing board cover 692 which is beneath the board. However, in the presence of securing clip, a force in direction D tends to pull finger 323 also in direction D. Finger 323 thus transfers the horizontal force into a vertical one, pushing top plate segment 320 upward. This in turn causes joining segment 340 to be flexed and thereby increases pressure from bottom plate segment 330 upward onto the ironing board and its cover. As a result of the coaction of the securing clip parts, a force exerted during ironing which would otherwise tend to loosen the ironing board cover, is not only posed but such a force actually tightens the grip of the securing clip on the ironing board and so effectively reduces or prevents any loosening of said cover.

Finger 333 further contributes to inhibit loosening by the transverse forces exerted on the ironing board surface during ironing. Because of the angled position of finger 333, the finger opposes any movement of ironing board cover 691 which would be caused by force in a direction D. Thus, finger 333 further contributes to maintaining the tightness of the ironing board cover 690 on the ironing board.

The securing clips are preferably installed on both sides of the ironing board. Thus, the holding action applies on both sides regardless of direction of travel of the iron.

In a further embodiment, the securing clip comprises a top plate 720, bottom plate segment 730 flexibly joined by joining segment 740. Top plate segment 720 has upper surface 721 and lower surface 722. Bottom plate segment 730 has upper surface 731 and lower surface 732 and joining segment 740 has internal surface 741 and external surface 742. At least one finger 723 protrudes downwardly from the lower surface 722 of top plate 720. Finger 723 and the lower surface 722 define an angle facing the internal surface 741 of joining segment of 90° or less.

Bottom plate segment 730 has two side edges 736 and 737 plus a joining edge 734 and a forward edge 735. A portion of bottom plate segment 730 at forward edge 735 departs from the planar to form a lip 750. Lip 750 has upper surface 751 and lower surface 752. Upper surface 752 of lip 750 extends substantially across the entire forward edge 735 outwardly from the space partially enclosed by internal surface 741, upper surface 731 and lower surface 722. Together with the upper surface 731 of bottom plate segment 730, the upper surface 752 of lip segment 750 defines an angle greater than 180°.

In a further embodiment, a portion of bottom plate 830 at side edge 836 departs from the planar to form a shoulder 860. Shoulder 860 extends from the internal surface 841 of joining segment 840 along side edge 836 to forward edge 835. Shoulder 860 has upper surface 861 and lower surface 862. Upper surface 861 forms an angle with the upper surface 831 of bottom plate segment 830, said angle being greater than 180°.

In yet a further embodiment of the securing clip, both the lower surface 922 of top plate segment 920 and the upper surface 931 of bottom plate segment 930 form angles of less than 90° with the internal surface 941 of joining segment 940. In this embodiment, the forward edge 925 of top plate segment 920 and the forward edge 935 of bottom plate segment 930 define a mouth. However, forward edges 925 and 935 are non-parallel. Accordingly, the width $W_m$ of the mouth tapers from one side to the other: $W_{m2}$ is greater than $W_{m1}$.

Figure 7:
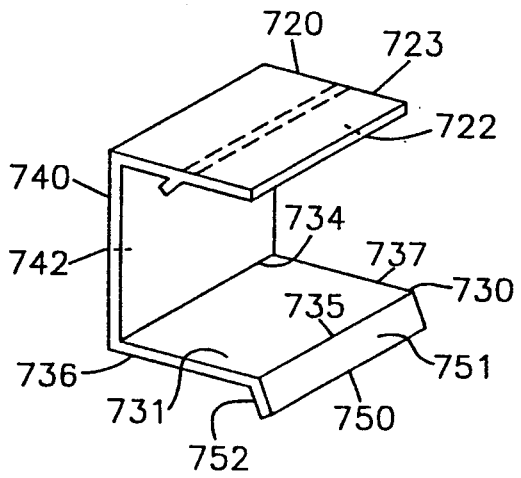
FIG. 7 is a downward perspective view of a further embodiment of a securing clip.
Figure 8:
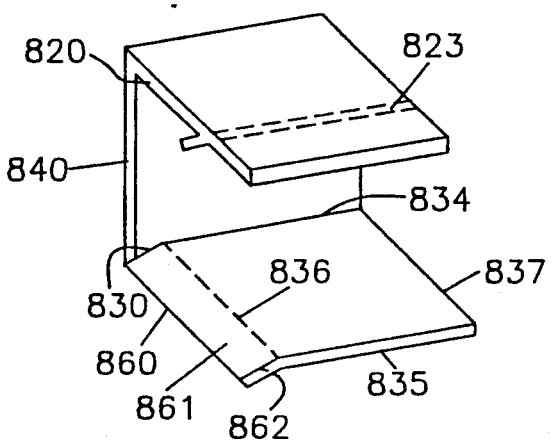
FIG. 8 is a downward perspective view of a further embodiment of a securing clip.

Both the lip 750 and the shoulder 860 illustrated in FIGS. 7 and 8 respectively, simplify engagement of the securing clip with an ironing board. When attempting to apply the securing clip (illustrated in FIG. 5), one places the forward edges 524 and 534 adjacent to the ironing board narrow side edge 572. Before one can push the clip into its effective position, one must rock the clip slightly to contact at least part of either lower surface 522 or upper surface 531 with the top or bottom of the ironing board respectively. Until such contact is made, pushing on external surface 542 in the direction D does not advance the clip. Once this initial contact is made, further rocking and pushing brings both opposed plate segment surface into contact with the desired ironing board surface. After this, pressure exerted on external surface 542 in direction D does effectively advance the securing clip into its position of use.

However, because one desires the securing clip to tightly grip the ironing board and its cover, the clip is dimensioned close to the width of the ironing board. That is, in clips where the top and bottom plate segments are planar and parallel, the width of the mouth $W_m$ (the distance from forward edge 524 to 534) is close in size to the thickness of the ironing board. In embodiments where the top and bottom plate segments are non-planar and/or non-parallel, the clip is dimensioned so the shortest distance between its top and bottom plate segments is close to the ironing board thickness.

As a result, when the ironing board cover is present, movement of the securing clip first into contact with the top or bottom of the ironing board, may be difficult.

It is to overcome this difficulty that either or both the lip 750 and shoulder 860 of FIGS. 7 and 8 may be incorporated. When lip 750 is present in a securing clip, one need not struggle to obtain a first contact between lower surface 722 or upper surface 731 and the top or bottom of the ironing board. Rather, one places the upper surface 752 of the lip in contact with the lower surface of the ironing board and then rocks the clip upward to bring lower surface 722 in contact with the upper surface of the ironing board. Inward pressure on external surface 742 at this point moves the clip into its position of use much more easily than when the lip is absent.

Similarly, shoulder 860 may assist one in introducing only one corner of the clip mouth over the ironing board. When shoulder 860 is present, one places upper surface 861 of the shoulder in contact with the bottom of the ironing board. Then pressing inward while rocking the securing clip upward, brings that corner of surface 822 which is above the shoulder surface 861 into contact with the upper surface of the ironing board. Inward pressure on external surface of joining segment 840 forces the rest of the securing clip mouth to widen and slide over the upper and lower surfaces of the ironing board, ultimately into position of use.

Figure 9:
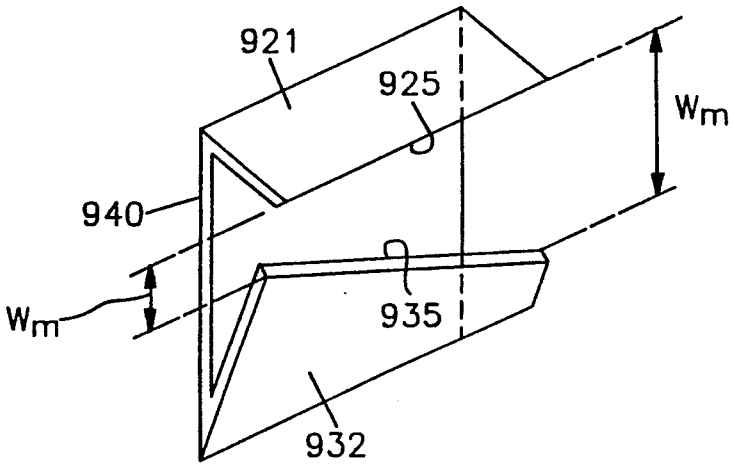
FIG. 9 is a downward perspective view of a further embodiment of a securing clip.
Figure 10:
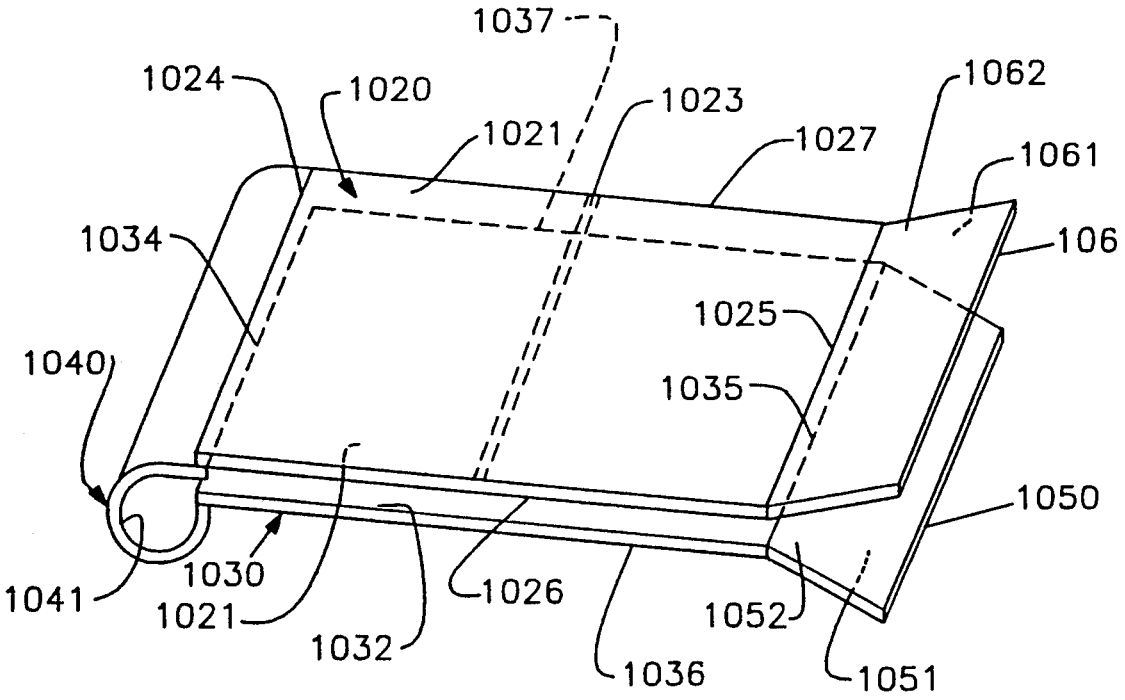
FIG. 10 is a downward perspective view of a further embodiment of a securing clip.

Particularly when the shoulder 860 is used in a securing clip, the mouth of varying width illustrated in FIG. 9 is also useful. For by introducing the wider portion of the mouth having the shoulder over the ironing board, one can more easily introduce the rest of the clip over the board by simple pressure with less or without rocking or adjustment of the clip.

In a further embodiment, the securing clip comprises a top plate segment 1020, bottom plate segments 1030, flexibly joined by joining segment 1040. Top plate segment 1020 has upper surface 1021 and lower surface 1022; bottom plate segment 1030 has upper surface 1031 and lower surface 1032 and joining segment 1040 has internal surface 1041 and external surface 1042. At least one finger 1023 protrudes downwardly from the lower surface 1022 of top plate segment 1020. Finger 1023 and lower surface 1022 define an angle facing the internal surface 1041 of joining segment 1040 of 90° or less.

Joining segment 1040 is a curved segment, suitably an arc or semi-circle in cross section, which may subtend tangentially from one or both plate segments.

Bottom plate segment 1030 has two side edges 1036 and 1037 plus a joining edge 1034 and a forward edge 1035. A portion of bottom plate segment 1030 at forward edge 1035 departs from the planar to form a lip 1050. Lip 1050 has upper surface 1052 and lower surface 1051. Upper surface 1052 of lip 1050 extends substantially across the entire forward edge 1035 outwardly from the space partially enclosed by internal surface 1041, upper surface 1031 and lower surface 1022. Together with the upper surface 1031 of bottom plate segment 1030, the upper surface 1052 of lip segment 1050 defines an angle greater than 180°.

Similarly, upper plate segment 1020 has a lip 1060. This upper plate segment has two side edges 1026 and 1027 plus a joining edge 1024 and a forward edge 1025. A portion of upper plate segment 1020 and forward edge 1025 departs from the planar to form the lip 1060. Lip 1060 has upper surface 1062 and lower surface 1061. Lower surface 1062 of lip 1060 extends substantially across the entire forward edge 1025 outwardly from the space partially enclosed by internal surface 1041, upper surface 1031 and lower surface 1022. Together with the lower surface 1022 of upper plate segment 1020, the lower surface 1062 of lip segment 1060 defines an angle greater than 180°.

Thus, the two lip segments 1050 and 1060 in this embodiment facilitate placement of the securing clip on an ironing board by reducing difficulty of the initial placement of the lip on the board edge.

The desirable dimensions of the securing clip are generally as follows: the height of joining segment 140 from lower surface 122 to upper surface 131 is desirably close to the thickness of standard ironing boards, that is in the range of from ⅜ to 1¼ inch. The length of top and bottom plate segments 120 and 130 (i.e., from the joining edge to the forward edge thereof) may be from ¼ to 2 inches. It is believed however that no more than ¾ inch is necessary. The distance between side edges of the top and bottom plate segments or of the joining segment may suitably from ¼ to 2 inches. However, it is believed that no more than 1¼ inch is necessary and that for appearance sake, the clip dimensions here be from ⅜ to 1 inch.

This embodiment of the securing clip may be dimensioned for use on boards of narrow thickness, e.g., boards which have edge banding rather than conventional square metal tubing. In such embodiments, the lower surface 1021 of upper plate segment 1020 and the upper surface 1032 of bottom plate segment 1030, define a narrow space. The distance between surfaces 1021 and 1032 is minimal as the clip is intended to grip only thin metal banding (generally having thickness of 0.030 inch) and two thicknesses of ironing board cover cloth.

Where the securing clip is intended to grip ironing boards made solely with edge banding in place of square metal tubing, the distance between opposed plate segment surfaces (such as between surfaces 1021 and 1032) may suitably be from 0.010 inch to 0.050 inch.

Fingers 123 and 333 may range in size from 1/100–⅛ inch and may be located on surface 122 and/or 131 at 1/16" from the surface 141 or the forward edge of plate segment 120.

The distance for lip 750 between forward edge 735 and the outermost portion of the lip may suitably be from 1/32–½ inch or from ⅛ to ½ inch. Similarly, the dimensions of shoulder 860 from side edge 836 to the furthest extent of the shoulder may be from 1/32–½ inch or from ⅛ to ½ inch. The tapering mouth (illustrated in FIG. 9) should have at its widest point, dimensions from slightly less than to only slightly greater than the width of the ironing board. At its narrowest point, the width of the mouth $W_m$ may be anywhere from 1/32 to ⅜ inch narrower than the width of the ironing board depending on the material making up the securing clip. In any event, what one wishes to avoid is a clip having one end of its mouth only loosely secured to the ironing board due to a mouth width much greater than that of the ironing board.

Suitable Materials for Securing Clip

The securing clip described herein should be flexible and elastic so that after stretching in initial placement on an ironing board, it returns (partially or completely) to its original shape and thereby tightly squeezes an ironing board cover onto the ironing board. Suitable materials include thermoplastics such as nylon, polyurethane and polypropylene; and light-weight rather flexible metals such as aluminum, copper, brass and steel and iron when used in thin sheets.

The thickness of the securing clip, e.g., from the internal to the external surface of the joining segment may be, depending on the material, from 1/64 to ⅛ inch. When metals are used to form the securing clip, the clip width dimension is preferably 1/64 to 1/16, while with thermoplastic securing clips, this dimension is preferably from 1/32 to ⅛ inch.

I claim:

1. A securing clip comprising:

a. a top plate segment having an upper and a lower surface;

b. a bottom plate segment having an upper and a lower surface;

c. a joining segment having an internal and external surface; said joining segment flexibly joining said top and bottom plates so that the lower surface of said top plate segment confronts the upper surface of said bottom plate segment, the two opposed plates and joining segment defining a partially closed space; and d. at least one finger protruding from the lower surface of said top plate segment downwardly into said space, each finger traversing the width of the segment to which it is attached, each finger being an extended member having two opposed substantially planar and parallel face segments, said finger face segments defining an angle with said lower surface of the top plate segment, said angle facing toward said joining segment and being from about sixty-five degrees to about ninety degrees; and e. at least one finger protruding from the upper surface of said bottom plate segment upwardly into said space, each finger traversing the width of the segment to which it is attached, each finger being an extended member having two opposed substantially planar and parallel face segments, said finger face segments defining an angle with said lower surface of the top plate segment, said angle facing toward said joining segment and being more than ninety degrees to about one hundred fifty degrees.

2. A securing clip according to claim 1 wherein the top plate segment and bottom plate segment are substantially planar.

3. A securing clip according to claim 2 wherein the internal surface of said joining segment defines a curved convex segment, whereby a cross-section of said partially closed space is U-shaped.

4. A securing clip according to claim 2 wherein said bottom plate segment has two side edges, a joining and a forward edge and wherein a portion of said bottom plate segment at the forward edge thereof departs from the planar to form a lip, where said lip has an upper and a lower surface, the upper surface of which extends substantially across the entire forward edge and protrudes outwardly from said partially enclosed space, defining with the upper surface of said bottom plate segment an angle greater than 180 degrees.

5. A securing clip according to claim 2 wherein said bottom plate segment has two side edges, a joining and a forward edge, and wherein a portion of said bottom plate segment at one side edge thereof departs from the planar to form a shoulder, said shoulder extending from said joining segment internal surface substantially along the entire length of said bottom plate segment side edge, said shoulder having an upper and a lower surface, the upper surface of said shoulder forming with the upper surface of said bottom plate segment an angle of greater than 180 degrees.

6. A securing clip according to claim 2 wherein the lower surface of said top plate segment and the upper surface of said bottom plate segment are substantially parallel, and said joining segment is a brace substantially perpendicular to said top and bottom plate segments.

7. A securing clip according to claim 2 wherein the internal surface of said joining segment and the lower surface of said top plate segment define a substantially perpendicular angle and the internal surface of said joining segment and the upper surface of said bottom plate segment define an angle less than ninety degrees.

8. A securing clip according to claim 2 wherein the internal surface of said joining segment and the lower surface of said top plate segment define an angle of less than ninety degrees and the internal surface of said joining segment and the upper surface of said bottom plate segment define an angle of less than ninety degrees.

9. A securing clip according to claim 8 wherein the forward edges of said top and bottom plate segments form a mouth having a first and a second side, said forward edges of the top and bottom plate segments being non-parallel, whereby the mouth tapers in width from said first to said second side thereof.

10. The clip according to claim 1 wherein said top plate lower surface has one finger.

11. A securing clip according to claim 1 wherein the bottom surface of said top plate segment and the upper surface of said bottom plate segment are parallel to one another.

12. A securing clip according to claim 1 wherein the internal surface of said joining segment and the lower surface of said top plate segment define a substantially perpendicular angle while the internal surface of said joining segment and the upper surface of said bottom plate segment define an angle less than ninety degrees.

13. A securing clip according to claim 1 wherein the internal surface of said joining segment and the lower surface of said top plate segment define an angle of less than ninety degrees and the internal surface of said joining segment and the upper surface of said bottom plate segment define an angle of less than ninety degrees.

14. A securing clip according to claim 1 wherein there are a plurality of fingers.

15. A securing clip according to claim 1 wherein the angle facing said joining segments is ninety degrees.

16. A securing clip according to claim 1 wherein the angle facing said joining segment is substantially ninety degrees.

17. A securing clip according to claim 1 wherein the angle formed by the finger protruding from the lower surface of said top plate, which angle faces said joining segment, is substantially 90°; and the angle formed by the finger protruding from the lower surface of the top plate segment, facing said joining segment, is substantially 90°.

18. An ironing board assembly comprising a) an ironing board having an upper and a lower horizontal surface and a peripheral vertical edge joining said horizontal surfaces;

b) an ironing board cover comprising an upper segment contiguous with said upper board surface and a peripheral flap extending downwardly from said upper segment at least as far as said lower surface;

c) an ironing board clip according to claim 1 securing said cover to said board, having been positioned by placing the open side of said clip opposite the joining segment adjacent said board peripheral edge with the top and bottom clip segments substantially parallel to said upper and lower board surfaces, and pushing on the external surface of said joining segment until its internal surfaces advances the ironing board cover into close contact with said board peripheral edge.

* * * * *